US010059546B2

(12) United States Patent
Kase

(10) Patent No.: US 10,059,546 B2
(45) Date of Patent: Aug. 28, 2018

(54) SHEET CONVEYING APPARATUS AND IMAGE FORMING APPARATUS

(71) Applicant: CANON KABUSHIKI KAISHA, Tokyo (JP)

(72) Inventor: Shota Kase, Poblacion (PH)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/056,841

(22) Filed: Feb. 29, 2016

(65) Prior Publication Data

US 2016/0257512 A1 Sep. 8, 2016

(30) Foreign Application Priority Data

Mar. 3, 2015 (JP) ..... 2015-041745

(51) Int. Cl.

| | |
|---|---|
| ***B65H 5/00*** | (2006.01) |
| ***B65H 5/36*** | (2006.01) |
| ***B65H 1/26*** | (2006.01) |
| ***B65H 5/06*** | (2006.01) |
| ***B65H 85/00*** | (2006.01) |
| ***B65H 5/38*** | (2006.01) |
| *B65H 3/66* | (2006.01) |

(52) U.S. Cl.

CPC ..... *B65H 5/36* (2013.01); *B65H 1/266* (2013.01); *B65H 5/062* (2013.01); *B65H 5/38* (2013.01); *B65H 85/00* (2013.01); *B65H 3/66* (2013.01); *B65H 2402/441* (2013.01); *B65H 2402/64* (2013.01); *B65H 2403/513* (2013.01); *B65H 2403/541* (2013.01); *B65H 2404/144* (2013.01); *B65H 2404/611* (2013.01); *B65H 2405/114* (2013.01)

(58) Field of Classification Search

CPC ..... B65H 3/66; B65H 5/36; B65H 2402/53

See application file for complete search history.

(56) References Cited

U.S. PATENT DOCUMENTS 8,508,819 B2 * 8/2013 Asada ..... B41J 13/10 271/4.01

2015/0028536 A1 * 1/2015 Takai ..... B65H 3/0684 271/117

FOREIGN PATENT DOCUMENTS

| | | |
|---|---|---|
| JP | 2005-31216 A | 2/2005 |
| JP | 2006-62808 A | 3/2006 |
| JP | 2007-240843 A | 9/2007 |

(Continued)

*Primary Examiner* — Howard J Sanders

(74) *Attorney, Agent, or Firm* — Canon U.S.A., Inc. IP Division

(57) ABSTRACT

A sheet conveying apparatus includes a main body, a stack unit having a contact portion and a stack portion on which a sheet is to be placed, a conveyance guide, and a moving member having a contacted portion. The stack unit can be inserted into and extracted from the main body. The conveyance guide can be located at a guide position for guiding the sheet conveyed on a conveying path and a release position for releasing the conveying path. The moving member moves the conveyance guide from the guide position to the release position by moving in a first direction from a first to a second position. The moving member moves from the first position in a second direction opposite the first direction by the stack unit contact portion contacting the moving member contacted portion when the stack unit is inserted to and extracted from the main body.

19 Claims, 11 Drawing Sheets

(56) References Cited

FOREIGN PATENT DOCUMENTS

| | | | |
|---|---|---|---|
| JP | 2011-136829 | A | 7/2011 |
| JP | 2013-180864 | A | 9/2013 |

* cited by examiner

SHEET CONVEYING APPARATUS AND IMAGE FORMING APPARATUS

BACKGROUND OF THE INVENTION

Field of the Invention

The present invention relates to a sheet conveying apparatus and an image forming apparatus.

Description of the Related Art

Some image forming apparatuses, such as copiers and printers, are capable of printing on both sides of a sheet. As shown in FIG. 9, Japanese Patent Laid-Open No. 2006-62808 discloses a typical configuration for double-sided printing in which a double-sided conveying unit 102 is disposed above a cassette 100 detachable from the main body 103 of an image forming apparatus.

In the configuration disclosed in Japanese Patent Laid-Open No. 2006-62808, a sheet is conveyed from the cassette 100 set at the lower part of the apparatus main body 103 to an image forming unit 101 to form an image on the first surface of the sheet. The sheet is then reversed and conveyed to the double-sided conveying unit 102, with which the sheet is conveyed again to the image forming unit 101, in which an image is formed on the second surface, and the sheet is discharged out of the apparatus main body 103.

The double-sided conveying unit 102 is releasable so as to clear a jam therein. A configuration for clearing the jam will be described with reference to FIGS. 10A to 10C.

FIG. 10A is a perspective view of the configuration, and FIGS. 10B and 10C are cross-sectional views thereof. As shown in FIGS. 10A to 10C, the double-sided conveying unit 102 includes a sheet conveying unit 107 and a double-sided conveyance guide 102*a* that guides a sheet conveyed by the sheet conveying unit 107. The sheet conveying unit 107 and the double-sided conveyance guide 102*a* are disposed in the apparatus main body 103. A sheet cassette 100 is detachably attached below the double-sided conveying unit 102.

As shown in FIGS. 10A to 10C, a shaft (not shown) secured to the apparatus main body 103 is supported in a hole 104 so that the double-sided conveying unit 102 is rotatably mounted to the apparatus main body 103. A downstream side of the double-sided conveying unit 102 in the sheet conveying direction (hereinafter referred to as "downstream side") is fixed to the apparatus main body 103 in such a manner that an upstream side in the sheet conveying direction (hereinafter referred to as "upstream side") is released. If sheet clogging (hereinafter referred to as "jam") occurs in the double-sided conveying unit 102, the user first draws the cassette 100, as shown in FIG. 10B. Then the user pushes down a lever 106 disposed at the double-sided conveying unit 102 adjacent to the front of the apparatus main body 103 to release the double-sided conveying unit 102. This allows the user to access the interior of the double-sided conveying unit 102 to clear the jam.

FIGS. 11A and 11B illustrate a known configuration including the rotatable lever 106 to release the double-sided conveying unit 102.

However, size reduction of the apparatus can lead to interference between the path of the rotation of the lever 106 and the path of the movement of the cassette 100 during inserting and extracting operations. The operation of inserting and extracting the cassette 100 can cause the lever 106 to malfunction, or the lever 106 can interfere with the operation of inserting and extracting the cassette 100.

The present invention provides a compact sheet conveying apparatus and a compact image forming apparatus in which the operation of inserting and extracting a cassette (a stack unit) is not interfered with.

SUMMARY OF THE INVENTION

A sheet conveying apparatus according to an aspect of the present invention includes an apparatus main body, a stack unit having a contact portion and configured to be inserted into and extracted from the apparatus main body, wherein the stack unit includes a stack portion on which a sheet is to be placed, a conveyance guide that can be located at a guide position for guiding the sheet conveyed on a conveying path and a release position for releasing the conveying path, and a moving member having a contacted portion and configured to move the conveyance guide from the guide position to the release position by moving in a first direction from a first position to a second position, wherein the moving member moves from the first position in a second direction opposite to the first direction by the contact portion of the stack unit coming into contact with the contacted portion of the moving member when the stack unit is inserted to and extracted from the apparatus main body.

In an example, a double-sided lever disposed below a double-sided conveying unit is retracted in a first direction when a cassette is inserted into and extracted from an apparatus main body. By rotating the double-sided lever in a second direction opposite to the first direction, the double-sided conveying unit can be moved from a guide position to a release position. Further features of the present invention will become apparent from the following description of exemplary embodiments with reference to the attached drawings.

DESCRIPTION OF THE EMBODIMENTS

First Embodiment

Referring to FIG. 1 to FIGS. 7A to 7C, a first embodiment of the present invention will be described. In the following description, a direction to the front of an apparatus main body 1 is direction F, a direction to the back of the apparatus main body 1 is direction B, the left of the apparatus main body 1 viewed from the front is direction L, and the right of the apparatus main body 1 viewed from the front is direction R.

Figure 1:
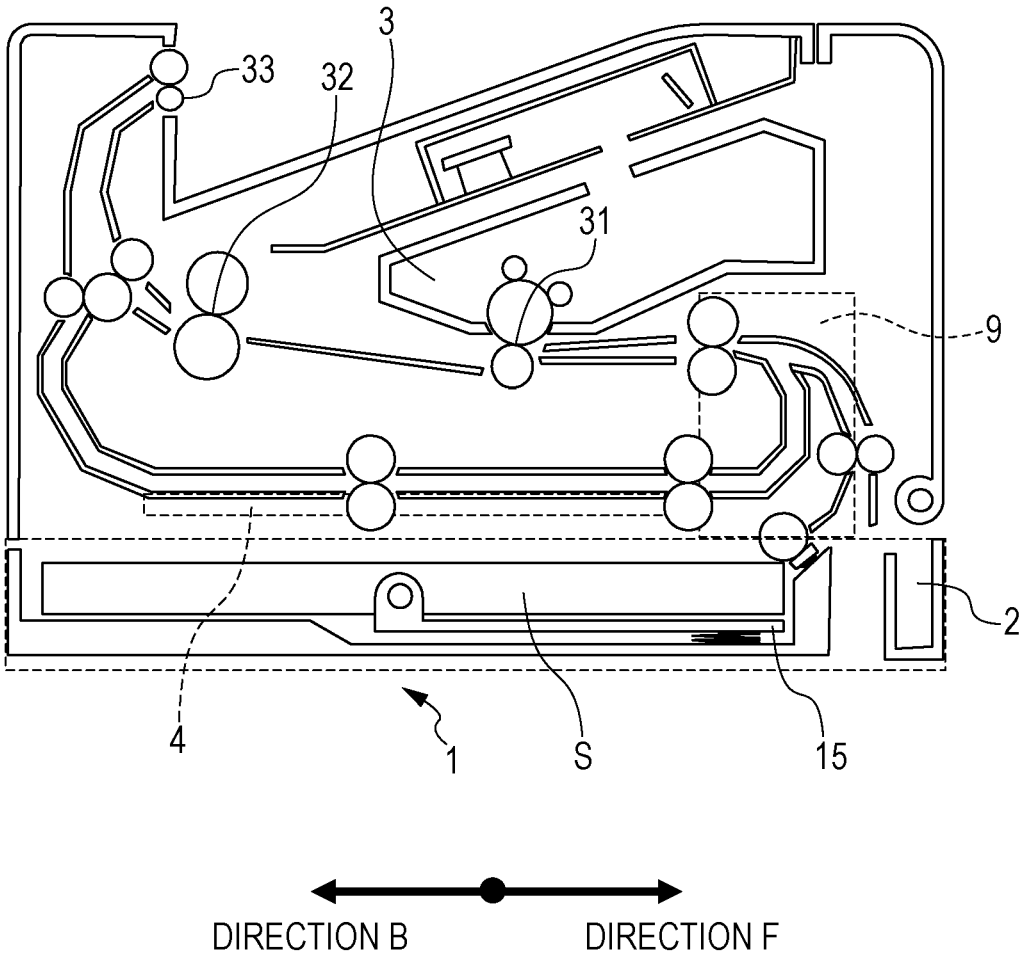
FIG. 1 is a diagram illustrating the general arrangement of an image forming apparatus according to a first embodiment of the present invention.

Referring first to FIG. 1, the configuration of an image forming apparatus to which the first embodiment is applied will be described. In the first embodiment, a sheet S placed on a stack plate 15 (a stack portion) of a cassette (a stack unit) 2 disposed at the lower part of an apparatus main body 1 is conveyed to an image forming unit 3, in which an image is formed on the first surface of the sheet S passing through a transfer unit 31 and a fusing unit 32. The sheet S is then conveyed to a double-sided conveying unit 4 by reverse rotation of a discharge roller pair 33. The sheet S passes through a re-conveyance guide 9 and again passes through the transfer unit 31 and the fusing unit 32, in which an image is formed on the second surface, and the sheet S is then discharged by the discharge roller pair 33.

Figure 2A:
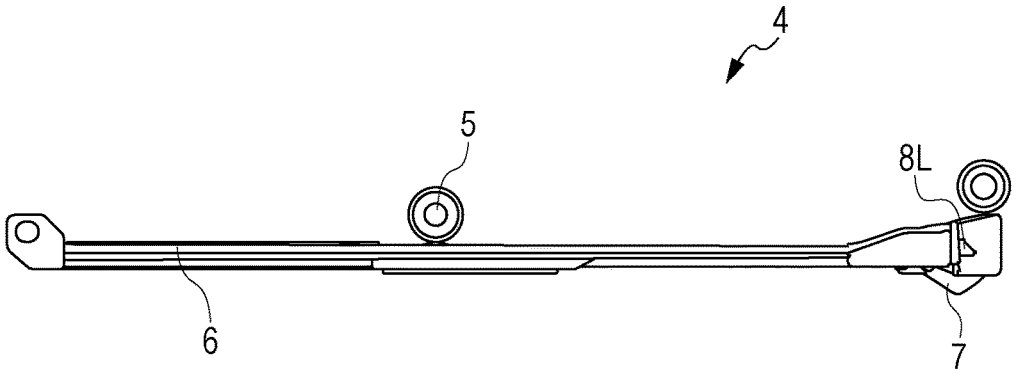
FIG. 2A is a diagram illustrating the configuration of a double-sided conveying unit according to the first embodiment.
Figure 2B:
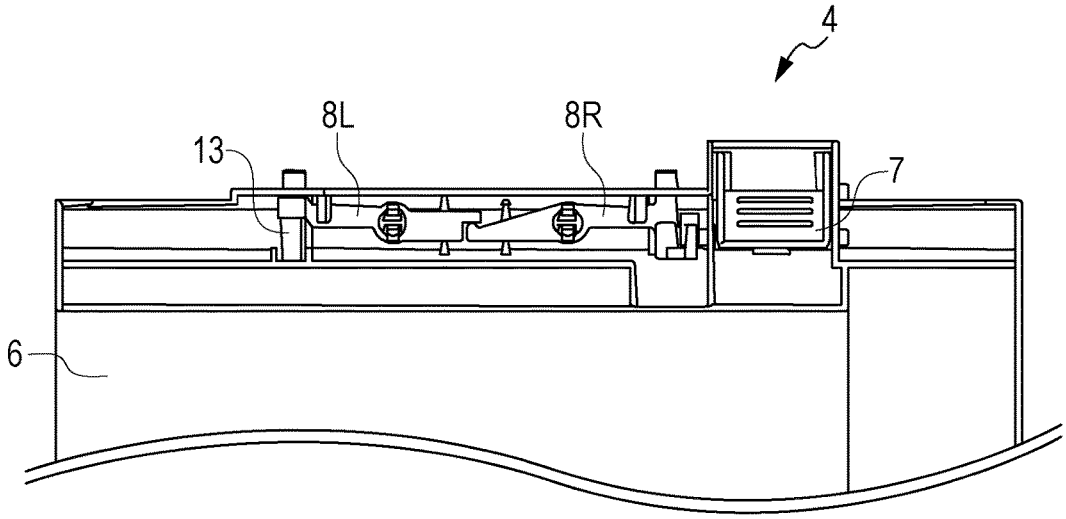
FIG. 2B is a bottom view of the double-sided conveying unit according to the first embodiment.

Referring next to FIGS. 2A and 2B, the configuration of the double-sided conveying unit 4 of the first embodiment will be described. FIG. 2A is a diagram illustrating the double-sided conveying unit 4 shown in FIG. 1, and FIG. 2B is a diagram of the double-sided conveying unit 4 shown in FIG. 2A viewed from the bottom. The double-sided conveying unit 4 includes a double-sided conveyance guide (a conveyance guide) 6 that guides the lower surface of the sheet S conveyed by a sheet conveying unit 5 of the apparatus main body 1 and a double-sided lever (a moving member) 7 disposed at the double-sided conveyance guide 6 adjacent to the bottom of the apparatus main body 1. The double-sided lever 7 is an operating member operable by the user. The double-sided conveying unit 4 further includes a first locking member (a first connecting member) 8R and a second locking member (a second connecting member) 8L, which are disposed downstream of the double-sided conveyance guide 6, and a spring member (an elastic member) 13 secured to the double-sided conveyance guide 6. The spring member 13 elastically urges the second locking member 8L upward. The first locking member 8R and the second locking member 8L are rotatable.

Figure 3A:
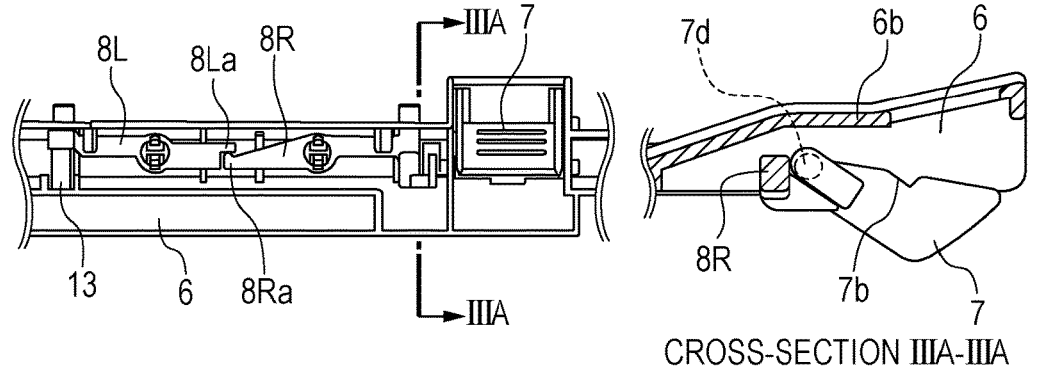
FIG. 3A is a bottom view of the double-sided conveying unit according to the first embodiment at a home position.
Figure 3B:
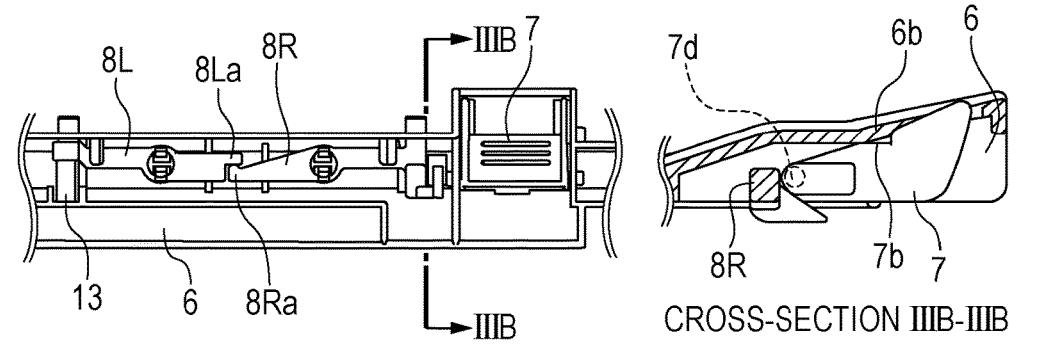
FIG. 3B is a bottom view of the double-sided conveying unit according to the first embodiment at a retracted position.
Figure 3C:
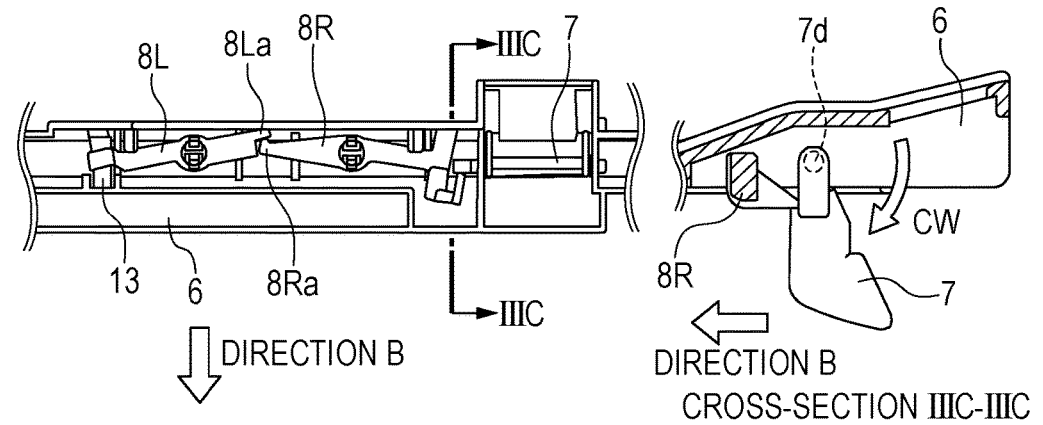
FIG. 3C is a bottom view of the double-sided conveying unit according to the first embodiment at a release position.

Referring next to FIGS. 3A to 3C, the operation of the double-sided conveying unit 4 according to the first embodiment will be described. The first locking member 8R and the second locking member 8L are rotatably supported by the double-sided conveyance guide 6.

FIG. 3A is a bottom view of the double-sided conveying unit 4, as FIG. 2B is, illustrating a state in which the first locking member 8R and the second locking member 8L are positioned so that the double-sided conveyance guide 6 is located at a home position (a first position). The double-sided conveyance guide 6 is at a conveying position (a guide position) at which the sheet S is conveyed by the sheet conveying unit 5. When the double-sided conveyance guide 6 is at the conveying position, an abutting portion 8La of the second locking member 8L urged by the spring member 13 is in contact with an abutting portion 8Ra of the first locking member 8R. Thus, the first locking member 8R and the second locking member 8L are positioned. In other words, the first locking member 8R and the second locking member 8L function as a holding unit (a connecting member) that holds the double-sided conveyance guide 6 at the conveying position.

The double-sided lever 7 is supported about a rotation axis 7*d* by the double-sided conveyance guide 6 and can pivot between the home position, shown in FIG. 3A, and a release position (a second position) shown in FIG. 3C. By the user rotating the double-sided lever 7 from the state shown in FIG. 3A in a direction CW (a first direction), the first locking member 8R and the second locking member 8L move in a direction B, and therefore the double-sided lever 7 moves to the release position, as shown in FIG. 3C.

FIG. 3B illustrates a state in which the double-sided lever 7 rotates from the home position in a direction CCW (a second direction opposite to the first direction, see FIGS. 6B and 6C) into a retracted position (a third position) when the cassette 2 is inserted or extracted). At that time, an abutting portion 7*b* of the double-sided lever 7 and an abutting portion 6*b* of the double-sided conveyance guide 6 are in contact with each other. The first locking member 8R and the second locking member 8L have not been moved in this state, and therefore the double-sided conveyance guide 4 is kept at the conveying position.

Figure 4A:
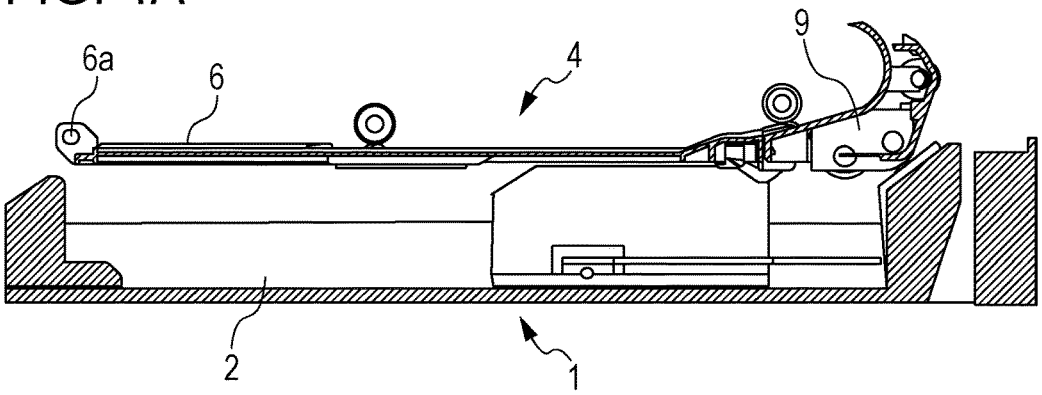
FIG. 4A is a diagram of the double-sided conveying unit according to the first embodiment.
Figure 4B:
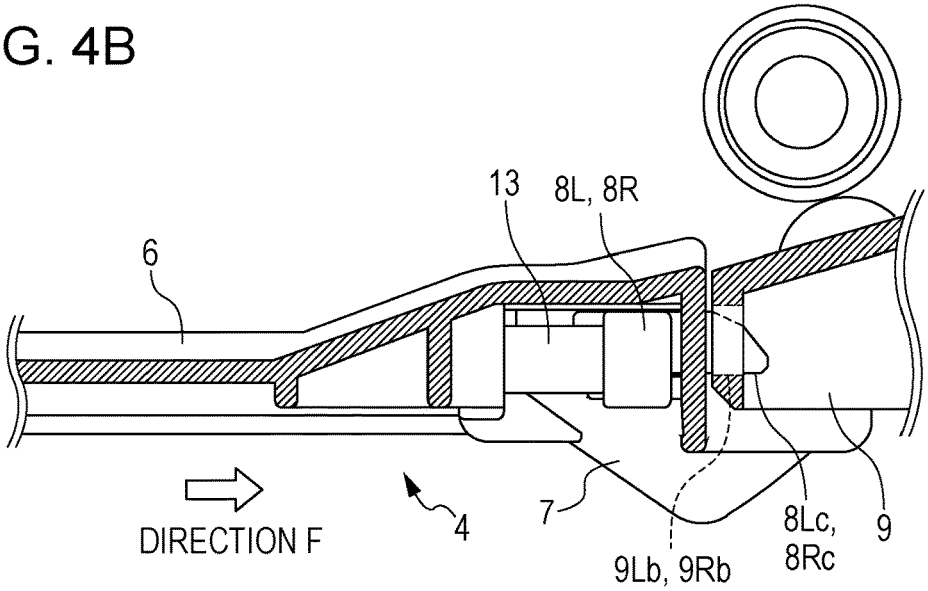
FIG. 4B is a diagram of the double-sided conveying unit according to the first embodiment illustrating a state at a conveying position.
Figure 4C:
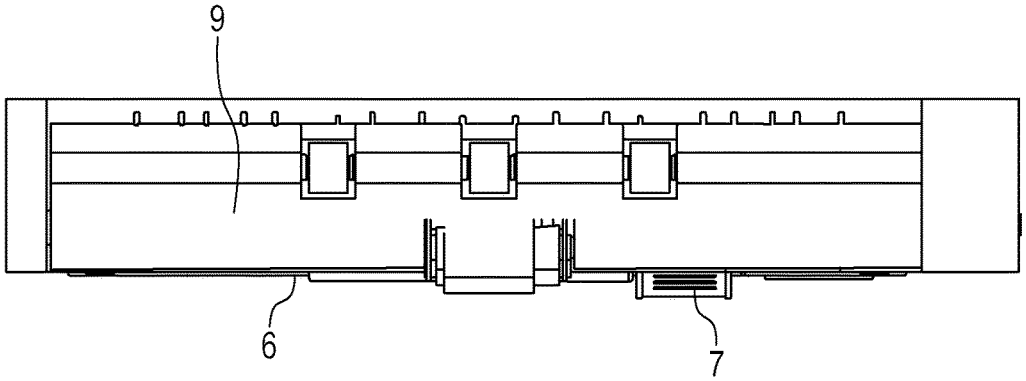
FIG. 4C is a diagram of the double-sided conveying unit according to the first embodiment illustrating a state at the conveying position.

Referring next to FIGS. 4A to 4C, the conveying position of the double-sided conveying unit 4 will be described. The double-sided conveying unit 4 is disposed above the cassette 2 detachably mounted to the apparatus main body 1. The double-sided conveying unit 4 is rotatably disposed at the apparatus main body 1 in such a manner that a hole 6*a* upstream of the double-sided conveyance guide 6 is supported by a shaft (not shown) of the apparatus main body 1. As shown in FIG. 4B, a bottom 8Rc of the first locking member 8R and a bottom 8Lc of the second locking member 8L respectively come into contact with holes 9Rb and 9Lb of the re-conveyance guide 9 secured to the apparatus main body 1, so that the double-sided conveyance guide 6 is fixed (held) at the conveying position at which the sheet S can be conveyed.

As shown in FIG. 4C, in a state in which the cassette 2 is drawn from the apparatus main body 1, and the double-sided conveyance guide 6 is at the conveying position, there is no object that shields the double-sided lever 7 as viewed from the direction F, allowing the user to recognize (view) the double-sided lever 7.

Figure 5A:
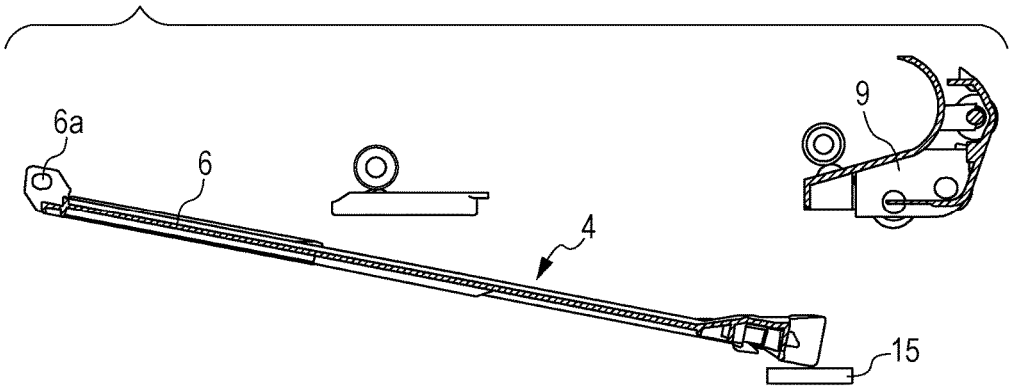
FIG. 5A is a diagram illustrating a jam clearing process in the double-sided conveying unit according to the first embodiment.
Figure 5B:
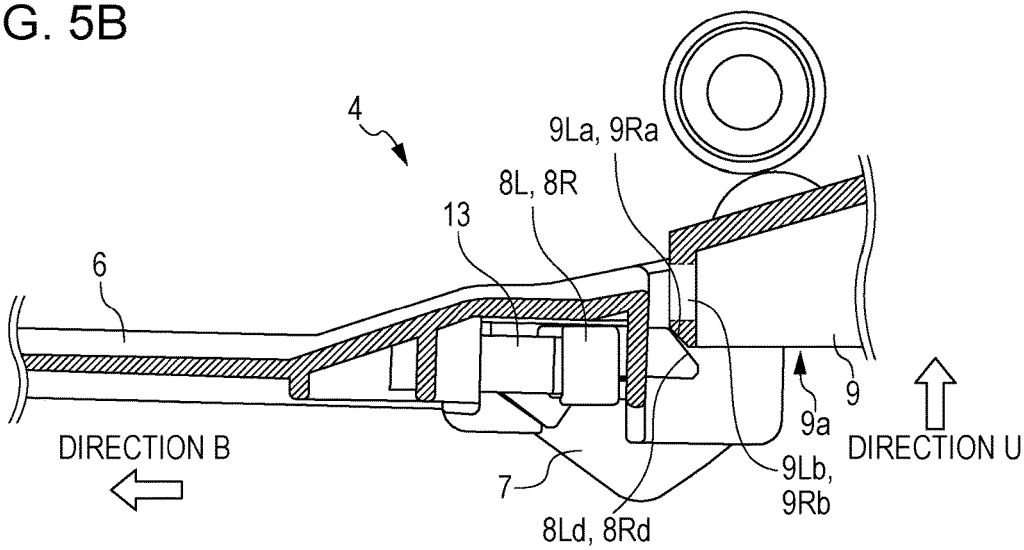
FIG. 5B is a diagram illustrating the jam clearing process in the double-sided conveying unit according to the first embodiment.
Figure 5C:
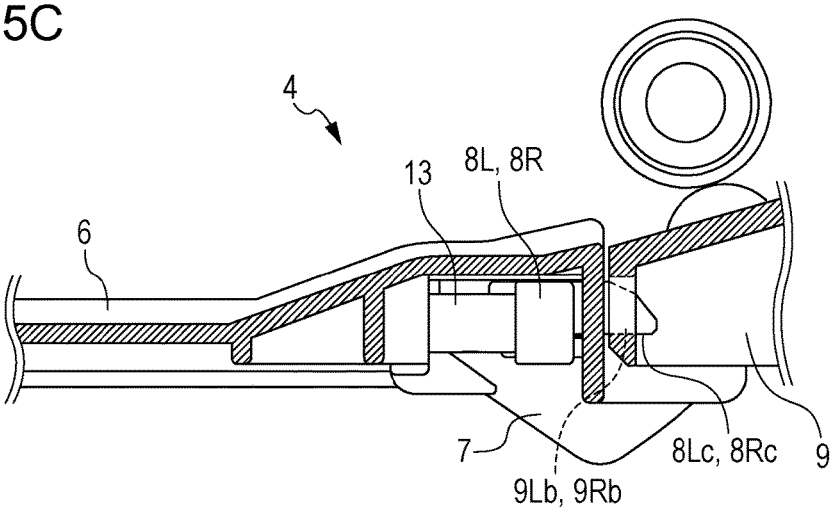
FIG. 5C is a diagram illustrating the jam clearing process in the double-sided conveying unit according to the first embodiment.

Referring next to FIGS. 5A to 5C, a process for clearing a jam of the sheet S in the double-sided conveying unit 4 will be described. If a jam occurs in the double-sided conveying unit 4, the user first draws the cassette 2 from the apparatus main body 1. The user then rotates the double-sided lever 7 from the home position to the release position. This releases the connection between the double-sided conveyance guide 6 and the re-conveyance guide 9 with the first locking member 8R and the second locking member 8L.

Then the double-sided conveying unit 4 rotates about the hole 6*a* under its own weight to move to a jam clearing position (a release position) at which the double-sided conveying unit 4 is in contact with the stack plate 15 or a floor (not shown) on which the apparatus main body 1 is disposed, as shown in FIG. 5A. In the state in which the double-sided conveying unit 4 is at the jam clearing position, a double-sided conveying path downstream in the direction of conveyance of the sheet S (at the front of the apparatus main body 1) is released. This allows the user to access the interior of the double-sided conveying unit 4 for jam clearance.

After completion of the jam clearance, the user raises the downstream side of the double-sided conveying unit 4 in the direction of arrow U (upward). This brings a slope 8Rd of the first locking member 8R and a slope 8Ld of the second locking member 8L into contact with a bottom 9*a* of the re-conveyance guide 9 and retracts the first locking member 8R and the second locking member 8L in the direction B, as shown in FIG. 5B. When the user further raises the double-sided conveying unit 4 in the direction U, the bottom 8Rc of the first locking member 8R and the bottom 8Lc of the second locking member 8L again come into contact with the holes 9Rb and 9Lb of the re-conveyance guide 9, as shown in FIG. 5C. This causes the double-sided conveying unit 4 to be again fixed at the conveying position in the apparatus main body 1.

Figure 6A:
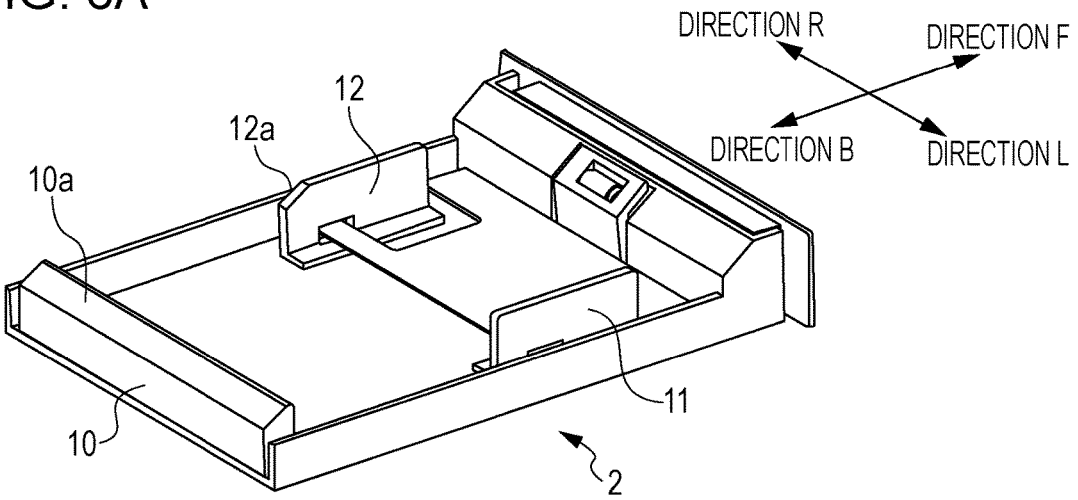
FIG. 6A is a diagram illustrating the operation of a double-sided lever when the cassette is inserted into the apparatus main body according to the first embodiment.
Figure 6B:
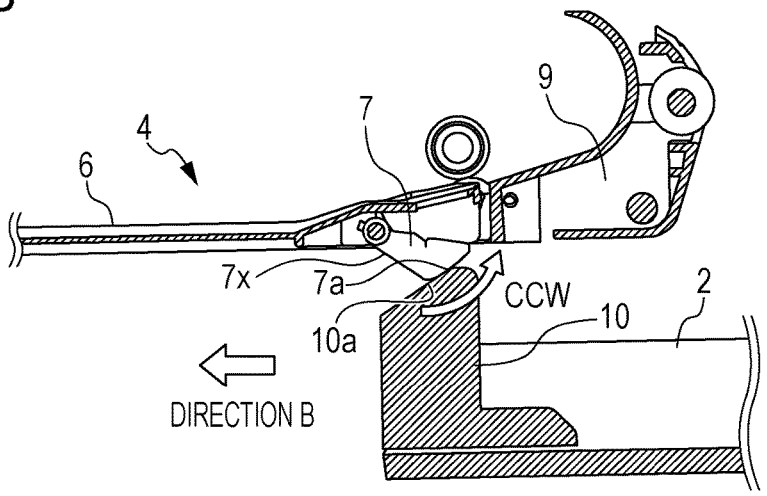
FIG. 6B is a diagram illustrating the operation of the double-sided lever when a cassette is inserted into the apparatus main body according to the first embodiment.
Figure 6C:
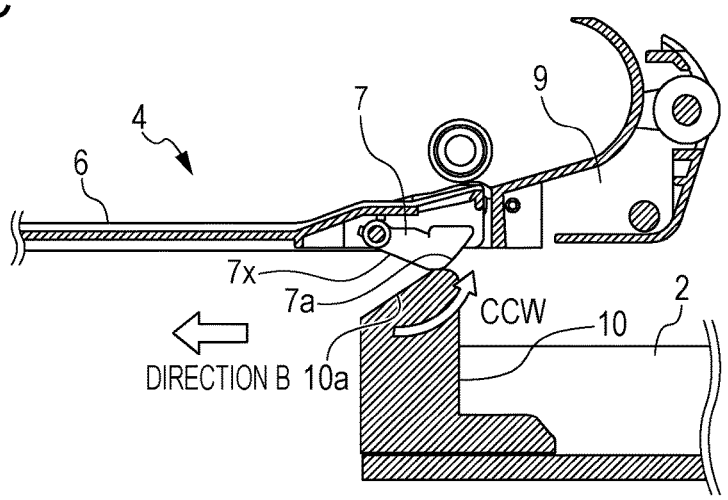
FIG. 6C is a diagram illustrating the operation of the double-sided lever when the cassette is inserted into the apparatus main body according to the first embodiment.

Referring next to FIGS. 6A to 6C, the operation of the double-sided lever 7 when the cassette 2 is inserted into the apparatus main body 1 will be described. The cassette 2 includes a rear-end regulating member 10, a first width regulating member 11, and a second width regulating member 12 to regulate the position of the sheet S according to the size of the sheet S.

The rear-end regulating member 10 can be moved in the direction of arrow F and the direction of arrow B (in the directions of insertion and extraction of the cassette 2) and regulates the position of the sheet S in the conveying direction. The first width regulating member 11 and the second width regulating member 12 can be moved in the direction of arrow L and the direction of arrow R and regulate the position of the sheet S in a direction perpendicular to the direction of conveyance of the sheet S (in the directions of insertion and extraction of the cassette 2).

When the user inserts the cassette 2 into the apparatus main body 1, a slope (a contact portion) 10*a* of the rear-end regulating member 10 comes into contact with a slope (a contacted portion) 7*a* of the double-sided lever 7, as shown in FIG. 6B. At that time, the double-sided lever 7 rotates in the direction of arrow CCW, which is an opposite direction from the rotating direction during jam clearance, as shown in FIG. 6C. This prevents the double-sided lever 7 from being damaged by collision between the double-sided lever 7 and the rear-end regulating member 10. This further prevents the cassette 2 from failing to come into the apparatus main body 1. In the first embodiment, the double-sided lever 7 has the slope 7*a*, and the rear-end regulating member 10 has the slope 10*a* so that the double-sided lever 7 rotates not in the direction CW but in the direction CCW. More specifically, the slope 7*a* and the slope 10*a* are shaped such that the upstream side in the direction of insertion of the cassette 2 rises.

Furthermore, the double-sided lever 7 rotates is the direction of arrow CW when the user clears the jam. This prevents the double-sided lever 7 from malfunctioning to move the double-sided conveying unit 4 to the jam clearing position when the cassette 2 is inserted into the apparatus main body 1.

When the user draws the cassette 2, a slope 7*x* of the double-sided lever 7 comes into contact with the slope 10*a* of the rear-end regulating member 10 to retract the double-sided lever 7 from the home position to the retracted position. The slope 7*x* is shaped such that the upstream side descends in the direction of insertion of the cassette 2 descends.

Figure 7A:
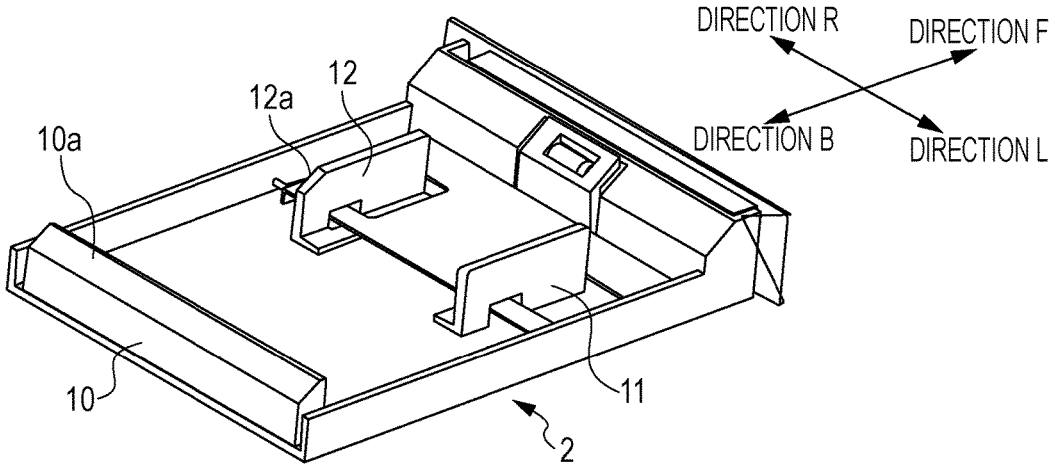
FIG. 7A is a diagram illustrating the operation of the double-sided lever when the cassette is inserted into the apparatus main body and when a small-sized sheet is set in the cassette according to the first embodiment.
Figure 7B:
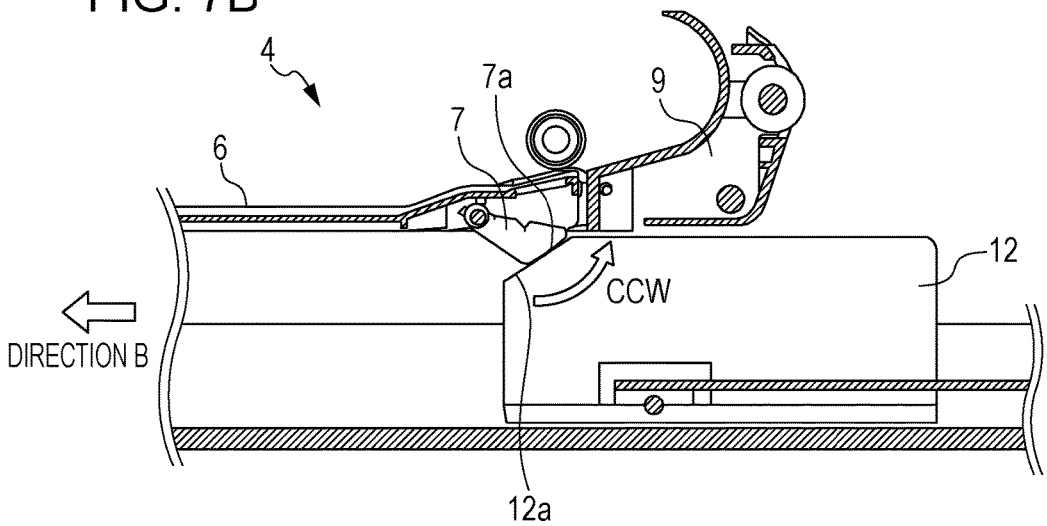
FIG. 7B is a diagram illustrating the operation of the double-sided lever when the cassette is inserted into the apparatus main body and when the small-sized sheet is set in the cassette according to the first embodiment.
Figure 7C:
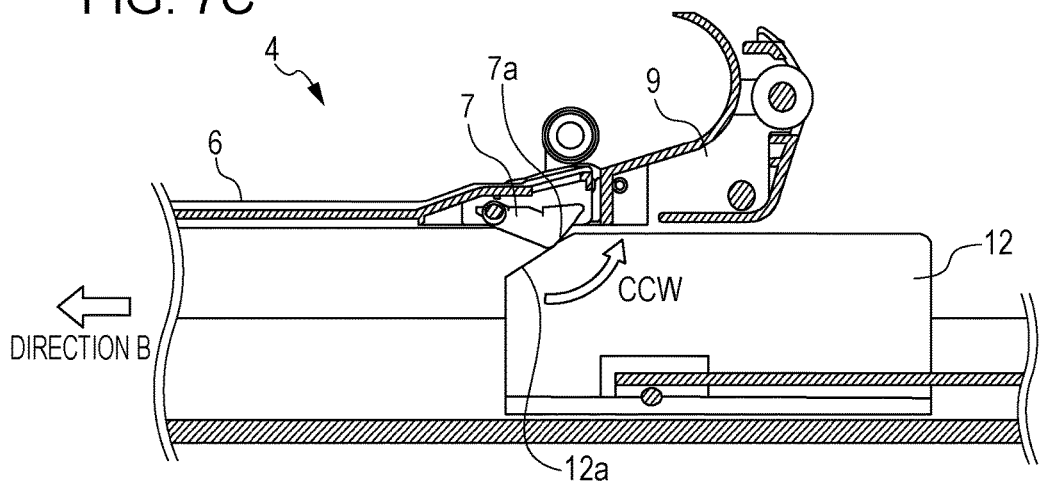
FIG. 7C is a diagram illustrating the operation of the double-sided lever when the cassette is inserted into the apparatus main body and when the small-sized sheet is set in the cassette according to the first embodiment.

Referring next to FIGS. 7A to 7C, the operation of the double-sided lever 7 when the cassette 2 is inserted into the apparatus main body 1 and when the sheet S set in the cassette 2 is small in width will be described.

When the sheet S set in the cassette 2 is small in width, such as A6 size, the user moves the first width regulating member 11 in the direction of arrow R and the sheet second width regulating member 12 in the direction of arrow L to regulate the width of the sheet S.

At that time, the positions of the second width regulating member 12 and the double-sided lever 7 agree (overlap) with each other in the directions of arrow L and arrow R (in the direction of movement of the width regulating member 12). When the cassette 2 is inserted into the apparatus main body 1 in this state, the double-sided lever 7, which is rotated in the direction of arrow CCW when the rear-end regulating member 10 passes through the double-sided lever 7, returns to the home position. Thereafter, as shown in FIG. 7B, the slope 7*a* of the double-sided lever 7 and a slope 12*a* of the second width regulating member 12 come into contact with each other. As shown in FIG. 7C, the double-sided lever 7 further rotates in the direction of arrow CCW.

As described above, in the first embodiment, the double-sided lever 7 is retracted from the path of insertion and extraction of the cassette 2 during the operation of inserting and extracting the cassette 2 in a configuration in which at least part of the double-sided lever 7 overlaps with the path of insertion and extraction of the cassette 2. Specifically, the double-sided lever 7 rotates in a direction opposite to the direction of rotation from the home position to the release position to rotate from the home position to the retracted position. This prevents the operation of inserting and extracting the cassette 2 from being interfered with by the double-sided lever 7 and allows size reduction of the apparatus main body 1.

Second Embodiment

Figure 8A:
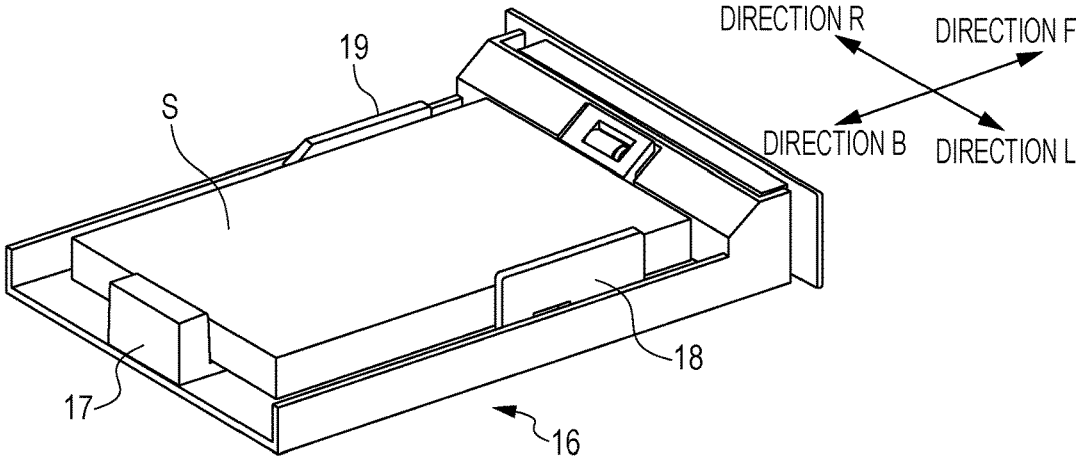
FIG. 8A is a perspective view of a cassette according to a second embodiment of the present invention.
Figure 8B:
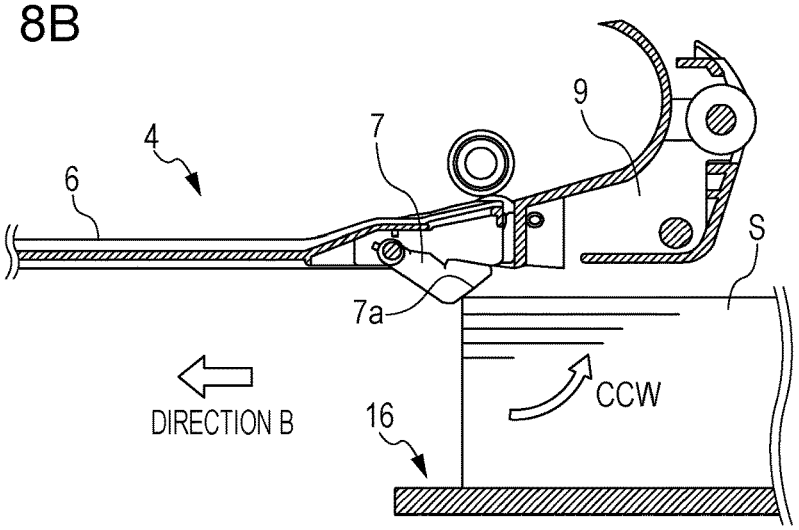
FIG. 8B is a partial cross-sectional view of FIG. 8A illustrating the operation of a double-sided lever when the cassette according to the second embodiment is inserted into the apparatus main body.
Figure 8C:
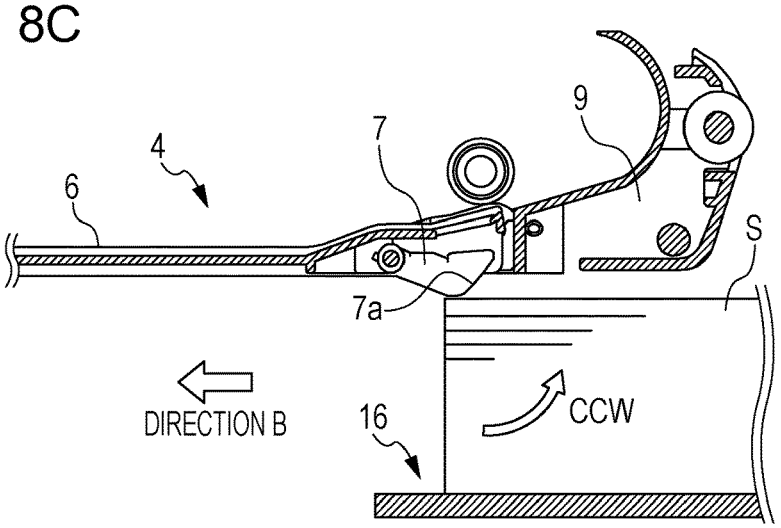
FIG. 8C is a partial cross-sectional view of FIG. 8A illustrating the operation of a double-sided lever when the cassette according to the second embodiment is inserted into the apparatus main body.
Figure 9:
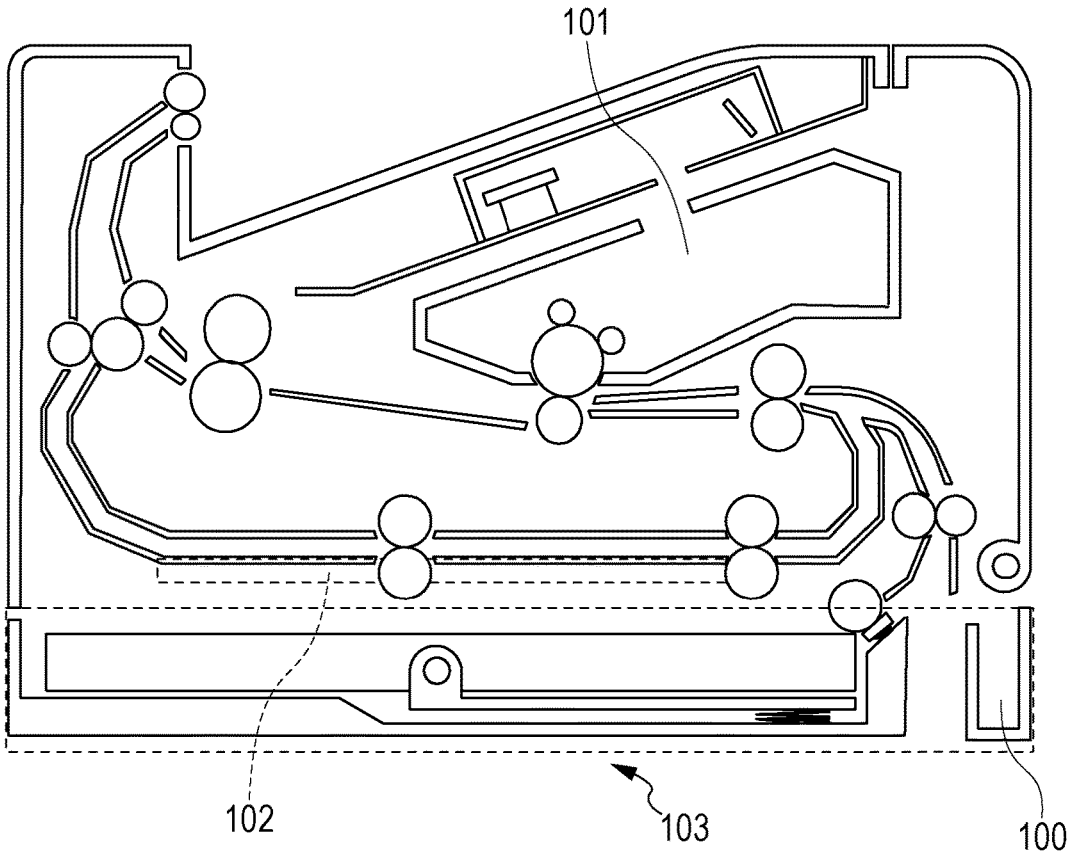
FIG. 9 is a diagram illustrating the general arrangement of a known image forming apparatus.
Figure 10A:
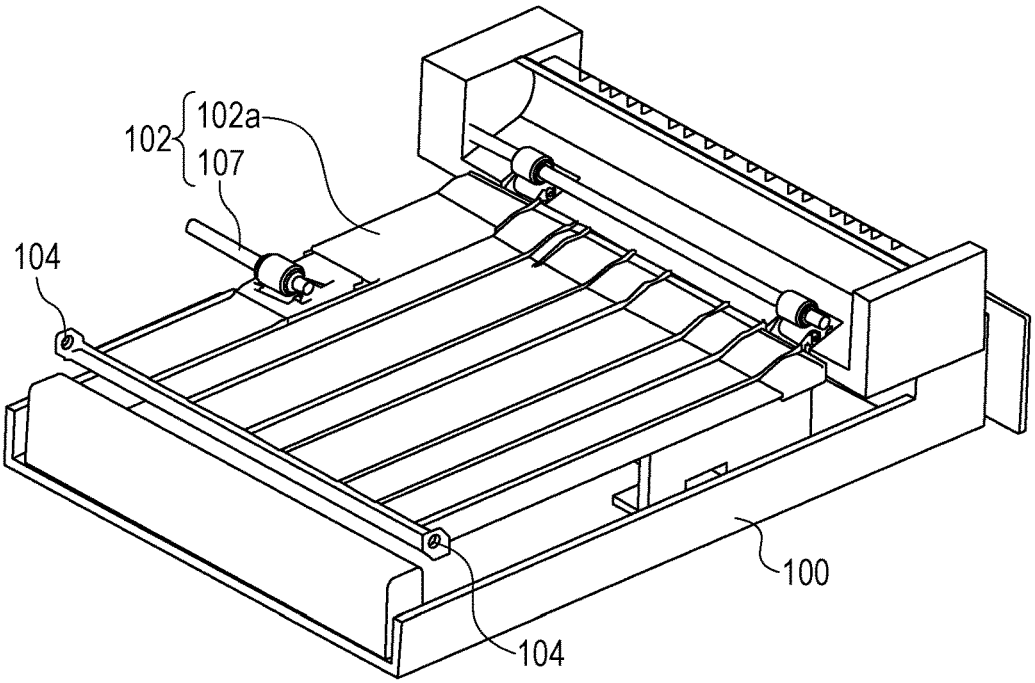
FIG. 10A is a perspective view of the configuration of the known image forming apparatus.
Figure 10B:
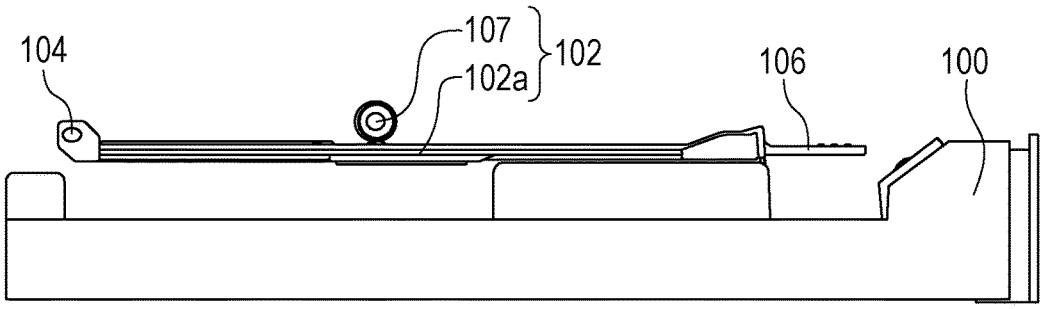
FIG. 10B is a cross-sectional view of FIG. 10A.
Figure 10C:
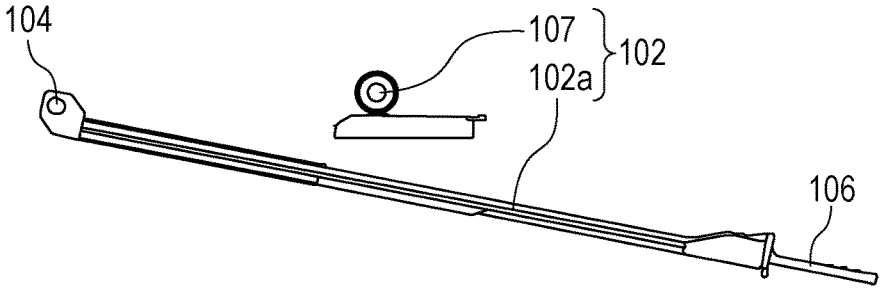
FIG. 10C is a cross-sectional view of FIG. 10A.
Figure 11A:
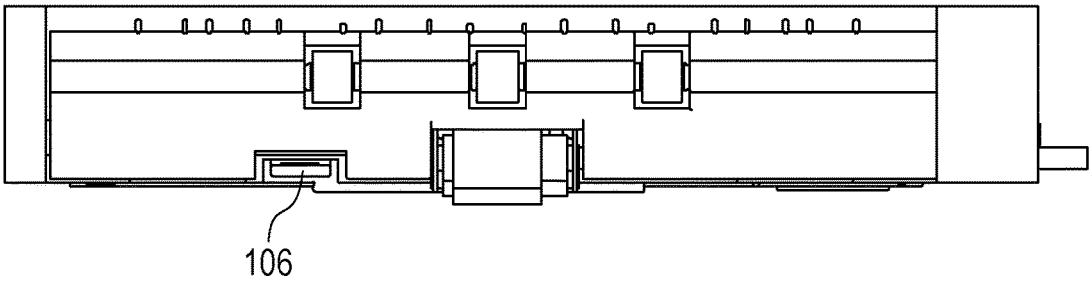
FIG. 11A is a diagram illustrating a known configuration.
Figure 11B:
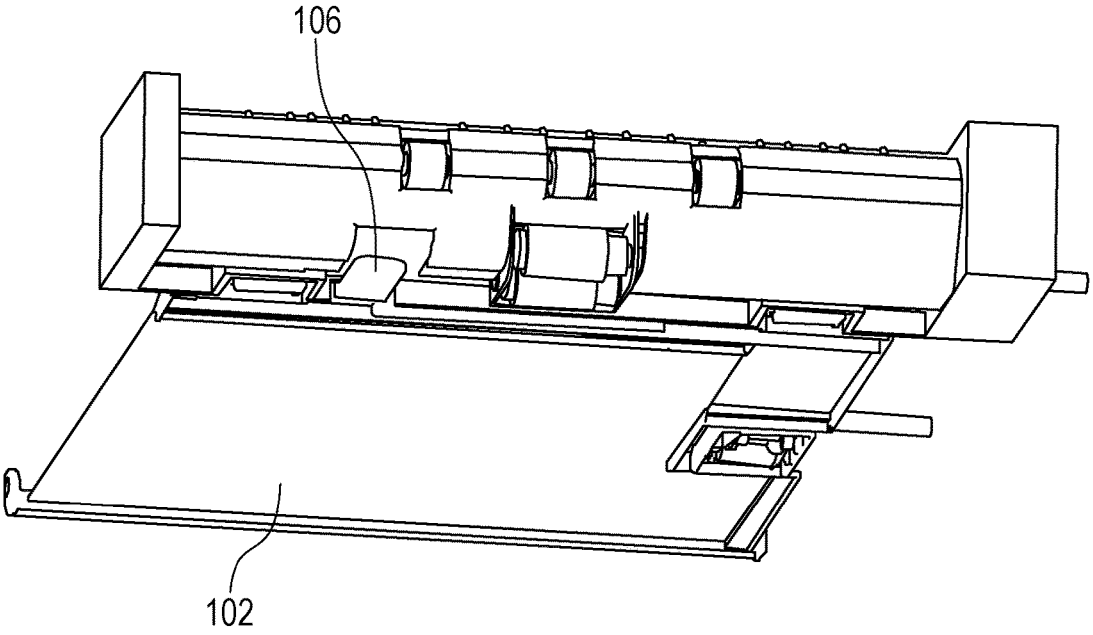
FIG. 11B is a perspective view of the known configuration.

Referring to FIGS. 8A to 8C, a second embodiment of the present invention will be described. In the second embodiment, descriptions of configurations and operations common to the first embodiment will be omitted as appropriate.

First, the configuration of the second embodiment will be described. As shown in FIG. 8A, a cassette 16 includes a rear-end regulating member 17, a first width regulating member 18, and a second width regulating member 19 to regulate the position of the sheet S. The rear-end regulating member 17 can be moved in the direction of arrow F and the direction of arrow B to regulate the position of the sheet S in its conveying direction. The first width regulating member 18 and the second width regulating member 19 can be moved in the direction of arrow L and the direction of arrow R to regulate the position of the sheet S in the width direction perpendicular to the direction of conveyance of the sheet S.

In the configuration of the second embodiment, the rear-end regulating member 17 is disposed only at the center in the width direction of the sheet S, unlike the first embodiment. Thus, in the configuration of the second embodiment, the rear-end regulating member 17 and the double-sided lever 7 are at different positions in the width direction (in the direction of (arrow L-R), and therefore prevents the rear-end regulating member 17 and the double-sided lever 7 from coming into contact with each other during insertion and extraction of the cassette 2.

The configurations and operations of the double-sided conveying unit 4 and the double-sided lever 7 in the second embodiment are the same as those of the first embodiment, and descriptions thereof will be omitted.

In the second embodiment, if the volume of sheets S stacked in the cassette 16 is large, the double-sided lever 7 comes into contact with the sheets S during insertion and extraction of the cassette 2, as shown in FIGS. 8B and 8C. When the user inserts the cassette 16 into the apparatus main body 1, the slope 7*a* of the double-sided lever 7 and the sheets S stacked in the cassette 16 come into contact with each other, as shown in FIG. 8B.

As shown in FIG. 8C, the double-sided lever 7 that has come into contact with the sheets S retracts from the home position to the retracted position as in the first embodiment.

Although the first and second embodiments have configurations in which the present invention is applied to the double-sided conveyance guide 6, the present invention should not be limited to the configurations. The present invention may be applied to a conveyance guide through which a manually inserted sheet passes, like the configuration disclosed in Japanese Patent Laid-Open No. 2013-180864, for example.

Although the first and second embodiments have a configuration in which the double-sided lever 7 rotates, the double-sided lever 7 may slide.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-041745, filed Mar. 3, 2015, which is hereby incorporated by reference herein in its entirety.

What is claimed is:

1. A sheet conveying apparatus comprising:

an apparatus main body;

a stack unit having a contact portion and configured to be inserted into and extracted from the apparatus main body, wherein the stack unit includes a stack portion on which a sheet is to be placed;

a conveyance guide that can be located at a guide position for guiding the sheet conveyed on a conveying path and a release position for releasing the conveying path;

a moving member having a contacted portion and configured to move the conveyance guide from the guide position to the release position by moving in a first direction from a first position to a second position; and a holding unit configured to hold the conveyance guide at the guide position, wherein the moving member moves from the first position in a second direction opposite to the first direction by the contact portion of the stack unit coming into contact with the contacted portion of the moving member when the stack unit is inserted to and extracted from the apparatus main body, wherein the holding unit comprises a connecting member connecting the moving member and the conveyance guide together, wherein, when the moving member moves from the first position to the second position, the connecting member moves so that the conveyance guide moves from the guide position to the release position, and wherein, when the moving member moves from the first position in the second direction, the holding unit holds the conveyance guide at the guide position.

2. The sheet conveying apparatus according to claim 1, wherein, when the moving member moves from the first position in the second direction, the connecting member does not move.

3. The sheet conveying apparatus according to claim 1, wherein the connecting member comprises a rotatable first connecting member and a rotatable second connecting member.

4. The sheet conveying apparatus according to claim 1, wherein the moving member comprises an operating lever operable by a user.

5. An image forming apparatus comprising:

the sheet conveying apparatus according to claim 1; and an image forming unit configured to form an image on both sides of the sheet, wherein the conveyance guide is a guide for conveying a sheet having the image printed on the first side of the sheet so that the image forming unit forms an image on a second side of the sheet.

6. The sheet conveying apparatus according to claim 1, wherein, in a condition that the conveyance guide is located at the guide position, the conveyance guide guides a lower surface of the sheet conveyed by a conveying roller provided to the apparatus main body.

7. The sheet conveying apparatus according to claim 1, wherein the moving member has a tip portion capable of abutting to the sheet stacked in the stack portion.

8. The sheet conveying apparatus according to claim 7, wherein the tip portion of the moving member is located at a downstream side with respect to the rotation axis in a sheet conveying direction.

9. A sheet conveying apparatus comprising:

an apparatus main body;

a stack unit configured to be inserted into and extracted from the apparatus main body, wherein the stack unit includes a stack portion on which a sheet is to be placed;

a conveyance guide that can be located at a guide position for guiding the sheet conveyed on a conveying path and a release position for releasing the conveying path;

a moving member configured to move the conveyance guide from the guide position to the release position by moving in a first direction; and a holding unit configured to hold the conveyance guide at the guide position in a case where the stack unit is inserted into the apparatus main body, wherein the conveyance guide is capable of retracting at least a portion of the moving member into the conveyance guide in a state where the conveyance guide is held by the holding unit at the guide position, and wherein, in the case where the stack unit is inserted into the apparatus main body, the moving member is retracted into the conveyance guide independently of the conveyance guide by coming into contact with the stack unit or a sheet placed on the stack portion.

10. The sheet conveying apparatus according to claim 9, wherein the moving member includes a slope sloped with respect to an insertion direction of the stack unit.

11. The sheet conveying apparatus according to claim 10, wherein the stack unit comprises a regulating member for regulating the sheet placed on the stack portion, and wherein, in the case where the stack unit is inserted into the apparatus main body, the moving member is retracted by the slope coming into contact with the regulating member.

12. The sheet conveying apparatus according to claim 11, wherein the regulating member can be moved in a direction of insertion and extraction of the stack unit.

13. The sheet conveying apparatus according to claim 10, wherein, in the case where the stack unit is inserted into the apparatus main body, the moving member is retracted by the slope coming into contact with the sheet placed on the stack portion.

14. The sheet conveying apparatus according to claim 9, wherein the moving member is rotatable about a rotation axis.

15. The sheet conveying apparatus according to claim 9, wherein, when the conveyance guide is at the guide position, the conveyance guide is disposed above the stack portion.

16. The sheet conveying apparatus according to claim 9, wherein the holding unit comprises a connecting member connecting the moving member and the conveyance guide together, wherein, when the moving member moves from the first position to the second position, the connecting member moves so that the conveyance guide moves from the guide position to the release position, and wherein, when the moving member moves in the first direction, the holding unit holds the conveyance guide at the guide position.

17. The sheet conveying apparatus according to claim 16, wherein the connecting member comprises a rotatable first connecting member and a rotatable second connecting member.

18. The sheet conveying apparatus according to claim 9, wherein the moving member comprises an operating lever operable by a user.

19. The sheet conveying apparatus according to claim 9, further comprising an image forming unit configured to form an image on a sheet, wherein the conveyance guide comprises a guide for conveying the sheet on a double-sided conveying path.

* * * * *